US007158642B2

(12) United States Patent
Tsuhako

(10) Patent No.: US 7,158,642 B2
(45) Date of Patent: Jan. 2, 2007

(54) METHOD AND APPARATUS FOR PRODUCING A PHANTOM THREE-DIMENSIONAL SOUND SPACE WITH RECORDED SOUND

(76) Inventor: Parker Tsuhako, 17016 Alexander Ave., Cerritos, CA (US) 24201

( * ) Notice: Subject to any disclaimer, the term of this patent is extended or adjusted under 35 U.S.C. 154(b) by 0 days.

(21) Appl. No.: 11/219,612

(22) Filed: Sep. 2, 2005

(65) Prior Publication Data

US 2006/0050890 A1 Mar. 9, 2006

Related U.S. Application Data

(60) Provisional application No. 60/607,358, filed on Sep. 3, 2004.

(51) Int. Cl.
*H04R 5/00* (2006.01)

(52) U.S. Cl. ..... 381/27; 381/17; 381/19

(58) Field of Classification Search ..... 381/17–23, 381/1, 27, 309, 310, 300, 74; 348/515
See application file for complete search history.

(56) References Cited

U.S. PATENT DOCUMENTS 4,199,658 A * 4/1980 Iwahara ..... 381/304
4,569,074 A 2/1986 Polk
4,841,573 A * 6/1989 Fujita ..... 381/27
5,068,897 A * 11/1991 Yamato et al. ..... 381/302
5,459,790 A 10/1995 Scofield et al.
5,661,812 A 8/1997 Scofield et al.
5,671,287 A 9/1997 Gerzon
5,742,689 A 4/1998 Tucker et al.
5,841,879 A 11/1998 Scofield et al.
6,009,179 A 12/1999 Wood et al.
6,144,747 A 11/2000 Scofield et al.
6,307,941 B1 10/2001 Tanner, Jr. et al.
6,424,719 B1 * 7/2002 Elko et al. ..... 381/1
6,434,250 B1 8/2002 Tsuhako
6,577,736 B1 6/2003 Clemow
6,766,028 B1 7/2004 Dickens
6,937,737 B1 * 8/2005 Polk, Jr. ..... 381/300
2002/0006206 A1 1/2002 Scofield

OTHER PUBLICATIONS

Greene, "Getting Surrounded Part I: How We Hear Multi-Channel Sound And How It Ought To Work," *The Perfect Vision*, Issue 30, pp. 62-65.
Greene, "Getting Surrounded II: Binaural Recording And Its Speaker Approximations," *The Perfect Vision*, Issue 31, pp. 47-50.

(Continued)

*Primary Examiner*—Xu Mei
(74) *Attorney, Agent, or Firm*—Fulwider Patton LLP

(57) ABSTRACT

A central speaker and personal headset speakers are used to create a three-dimensional phantom sound space for each listener. The speakers of the headset are located in close proximity to, but do not isolate, the ears of the listener such that external sounds are allowed to impinge upon the pinna of the ears. The headset speakers form an isosceles triangle with the distant central speaker as the apex. This speaker configuration with personal controls can achieve a state of sound equilibrium for a phantom three-dimensional sound space. The sound signal may be synchronized with a video signal, and the sound pressure level of the left and right speakers can be adjusted to control the listener's perception of the virtual movement of phantom sound source image within the sound space according to changes in the point of view represented in a displayed video image.

21 Claims, 6 Drawing Sheets

OTHER PUBLICATIONS

Harley, "How To Position Home-Theater Loudspeakers," *The Perfect Vision*, Issue 31, pp. 57-61.
Advertisement for "The Binaural Source", *What is Binaural?*, undated.
Buettner, "The TAS Interview, Going Beyond Two Channel: David Chesky of Chesky Records Talks With Shane Beuttner," *The Absolute Sound*, undated, pp. 51-57.
Advertisement for "Soundmatters MAINstage," undated, p. 71.
Harley, *The Complete Guide to High-End Audio*, 2d Ed., 1998, pp. 35-123, Acapella Publishing, Albuquerque, NM, USA.
Brockhouse, "2 Will Get You 5," *Stereo Review*, Aug. 1998, pp. 59-63.
Fenton, "Quick Takes: Its All In Your Head: Sony MDR-DS5000 Dolby Digital Headphones," Jun. 1999, p. 77.
Eargle, "One, Two, Five, Ten . . . And Counting," *Audio*, Jun. 1999, pp. 25-26.
Holman, *5.1 Surround Sound: Up And Running*, 2000, pp. 115-131 and 203-222, Focal Press, Boston, MA, USA.
Ranada, "Fear Of The Center Channel," *Sound & Vision*, Nov. 2000, p. 40.
Wood, "Surround-Speaker Configuration Wars," *Home Theater*, Apr. 2000, pp. 97-106.
Howard, "Out Of Your Head," *Hi-Fi News & Record Review*, Apr. 2000, pp. 64-67.
Ulano, "The Neumann KU 100 Dummy Head Condenser Mic: an Anatomical Replica Of A Human Head," *Pro Audio Review*, Jul. 2000, pp. 44 and 46.
"What You Should Know About," *The Perfect Vision*, Sep./Oct. 2001, pp. 35-37.
Wilkinson, "Higher Math & Higher Speakers," *Home Theater*, Nov. 2001, pp. 13, 138 and 140.
Holt, "Surround Sound The Four Reasons," *The Absolute Sound*, Apr./May 2002, pp. 31-33.
Holt, "Multichannel Imaging," *The Absolute Sound*, Jun./Jul. 2002, pp. 34-35.
Cherun, "DVD-Audio Meets DTS Entertainment," *DVD ETC*, Aug./Sep. 2002, pp. 75-76.
"Interview wit David Del Grosso," *DVD ETC*, Aug./Sep. 2002, p. 77.
Ranada, "Fixing A Hole," *Sound & Vision*, Jan. 2003, p. 39.
Martinez, "In The Studio With AIX Records," *DVD ETC*, Oct. 2003, pp. 100-101.
Ranada, "Slicing The Multichannel Pie," *Sound & Vision*., Nov. 2003, p. 39.
Pohlman, "The Lion King's New Roar," *Sound & Vision*, Nov. 2003, pp. 116-118.
Ranada, "Multichannel Revisionism, " *Sound & Vision*, Feb./Mar. 2004, p. 33.
Ranada, "Pushing The Envelopment," *Sound & Vision*, Jun. 2004, p. 33.
"5.1 Surround Sound Explained," *Essential Home Cinema*, undated, p. 85.
Advertisement for "Phase Technology," undated.
"The Surround Formats," undated.
Advertisement for "Denon Electronics," undated.

* cited by examiner

METHOD AND APPARATUS FOR PRODUCING A PHANTOM THREE-DIMENSIONAL SOUND SPACE WITH RECORDED SOUND

This application claims the benefit of U.S. Provisional Application No. 60/607,358 filed on Sep. 3, 2004, the contents of which are hereby incorporated by reference in their entirety.

FIELD OF THE INVENTION

The present invention relates in general to a sound reproduction system, and, more particularly, to a system for producing a three-dimensional sound space.

BACKGROUND OF THE INVENTION

Prior sound reproduction systems attempted to reproduce the audio realism of three-dimensional spaciousness through the application of sophisticated electronic technology to virtualize the third dimension of sounds or to form immersive sound fields with multichannel surround sound formats. However, this can be costly with limited effectiveness, and the realism of three-dimensionality of sound is left partly to the listener's imagination as to what is being heard and what is intended to be heard.

Multi-speaker formats, such as a 5.1 speaker set-up, are well known for creating an immersive sound space. However, the use of large numbers of speakers adds to the "confusion" of the total sound space. For a listener, increasing the number of speakers increases the number of segments of two-dimensional lateral sound fields. This condition is prone to producing poor and confusing stereo effects and less sound transparency. Some systems attempt to broaden the soundstage by processing front-channel signals to fool the ear-brain into "hearing" sounds beyond the left and right speakers. However, to experience the optimal effect of such systems, the listener is often required to be confined to a particular seating position within a small sweet spot formed within the sound space. As one moves from the sweet spot for listening to the soundscape produced by the multiple speakers, the virtual surround effect collapses. This can happen even when one merely rotates one's head. There may also be smeared images where different frequencies can appear to come from different directions.

Some sound reproduction systems record and playback binaural sound. Binaural recording is a method of recording audio which uses a special microphone arrangement. Binaural recording is done with an artificial or "dummy" head replicating the human head, and small omnidirectional microphone condensers mounted at or near the entrance to the ear canals in the artificial head. Typical stereo recordings, on the other hand, are mixed for loudspeaker arrangements, and do not factor in natural crossfeed or sonic shaping of the head and ear.

People perceive sound in three dimensions, and localization of sound depends on how the sound waves from the same source differ from each other as they reach the left and right ears. A Head Related Transfer Function (HRTF) describes how free-field incoming sound waves are modified by the presence of a listener in the field, including the scattering of sound off the listener's pinna, head, and torso. A HRTF is the Fourier transform of the impulse response from the source of the sound to the human tympanic membrane (eardrum). For example, to generate a sound that seems to come from the right side of the ear, we need to have the HRTF of the human ear's impulse response to sound coming from the right direction. Since the HRTF is from the source of the sound to the tympanic membrane (eardrum), it is a function of frequency, azimuth and elevation (the path that sounds travel to the ear), as well as the pinna structure (where sound is collected and reflected into the eardrum).

HRTFs can be used to generate binaural sound. If properly measured and implemented, HRTFs can generate a "virtual acoustic environment." Measuring HRTFs, however, can be expensive. A typical set up requires an anechoic chamber and high quality audio equipment. The anechoic chamber is used to minimize the influence of early reflections and reverberation on the measured response. Even the most carefully taken measurements, however, suffer from what often is referred to as "cones of confusion" and "inside the head" effects. And HRTFs can show considerable person-to-person variability. For the mass market, there have been attempts to use generic HRTFs, but these do not work as well as individualized HRTFs.

Present formats of multichannel surround sound, virtualization, binaural and others designed to overcome these shortcomings of depthless sound field are problematic. In order to repropagate a three-dimensional sound space which approximates the original pre-recorded sonic state, the experiments indicate that instead of relying on the powers and versatilities of electronic audio and digital processing and present techniques of recording and remixing, a unique approach to resolve this problem is necessary. There is a need for a method which can remedy the deficiency mentioned above by recreating in phantom form the three-dimensionality of multichannel recordings when replayed on conventional electronic playback systems.

SUMMARY OF THE INVENTION

The present invention relates to methods of creating a phantom three-dimensional sound space from recorded multichannel sounds of music, TV programs, home and public theaters, electronic games, computers, and the like when replayed on conventional electronic playback systems. The present invention also pertains to methods of altering a listener's perception of presence to the sound stage of live performances as well.

The present invention forms the third dimension of recorded sound space using a unique method when compared to presently common formats of creating an immersive surround sound effect with the use of multi-speakers to simulate a three-dimensional sound space or techniques to virtualize a surround sound with electronic processing. The present formats have inherent problems which diminish the effectiveness of developing a believable three-dimensional sound space with phantom sound images. The present invention can produce a more accurate and revealing sound space with stable phantom sound images than is presently possible.

This speaker configuration and the use of Sound Pressure Level (SPL) control means in the preferred embodiment of the invention will: create a more stable and uniform sound space by eliminating seams, vacillations and frequency and timbre variations between speakers; eliminate or reduce problems associated with Head Related Transfer Functions (HRTF) and sweet spot sensitivity; minimize the number of speakers necessary to create phantom three-dimensional sound space and thereby remove the complexities of their proper placements; provide each listener in a group of listeners the means necessary to make independent Sound Pressure Level (SPL) adjustments without interfering with those of other listeners; increase the number of sweet spots available to a listening audience, by individualizing each listener's sound space; provide the means necessary to vary a listener's perception of presence to the stage of a live performance; and provide a format whereby sound images and their sound effects can be maneuvered in three dimensions during the remixing stage of recorded sounds.

The preferred embodiment of the present invention will also make the electronic entertainment arena, sound-wise, a more "user-friendly" experience by providing each listener with independent "hands-on" opportunities to make personal adjustments to create individualized sound space and thereby remove the common notion that "one-size-fits-all" regarding a listener's preference of sound effects.

One embodiment of the present invention would allow each listener to make individual adjustments to accommodate any personal hearing deficiency which may compromise the total sound effect of what a listener hears, and give a listener of a live performance the ability to be perceptually mobile to change locations in an audience with the use of SPL control means.

The present invention involves a method to create phantom three-dimensional sound space and its sound images and sound effects with recorded sounds when recorded sounds are replayed on conventional electronic playback systems by: (a) employing a number of speakers to from two separate sound sources with similar sound contents and wherein the two sound sources are longitudinally aligned with a listener; (b) locating one of the two sound sources at close proximity to the listener and positioning the other sound source at a farther distance away from the listener; (c) providing the listener with SPL control means to enable the listener to make SPL adjustments to the sound source; and thereby form a z-axis between the two sound sources to create a phantom three-dimensional x-y-z axes sound space.

The method of one embodiment of the present invention also involves using recorded sound images in phantom form which can suspend themselves or move about in the so formed phantom sound space as they existed in the true three-dimensional sound space prior to their being recorded; wherein the recorded phantom sound images can be traversed to any point in the so formed phantom sound space by varying the SPL of the speakers and thereby cause the sound images to move according to the Haas Principle of Precedence and the proper geometric disposition of the speakers relative to a listener's location.

In the method of one embodiment of the present invention, the speakers which form the two sound sources are disposed in an isosceles triangular shaped layout with at least one speaker at each of its three vertexes. The two speakers located at the base of the triangle are situated at close proximity to the listener and the third speaker is located at the more distant apex of the triangle. The two speakers at the base of the triangle are positioned to form phantom sound images between them in the frontal lateral left to right sound field. The two speakers at the base of the triangle and the speaker at the distant apex of the triangle form phantom sound images in the longitudinal front-to-back sound space between the two separate sound sources. Each of the speakers is connected by wire or wireless means to a SPL control means which is connected to an amplifier to permit a listener to make SPL adjustments to the speakers individually or in unison to establish a state of SPL equilibrium among the speakers. Accordingly, two sound fields are formed which are generally perpendicularly aligned to each other.

In the method of one embodiment of the present invention, the phantom three-dimensional sound space is individualized in the shape of an isosceles triangle for each listener independent of other listeners who are listening to the same recorded sound by: (a) providing each listener with a close proximity sound source which is composed of two speakers which are situated at close proximity to a listener's ears with one speaker at each ear; (b) providing a second sound source of at least one speaker at the apex of the isosceles triangle which is located longitudinally at a farther distance from a group of listeners and is shared in common by al the listeners as a community sound source; and (c) providing each listener with independent SPL control means with which to make SPL adjustments to each of the two speakers at close proximity speakers in unison to equal the optimally preset SPL of the distant sound source to establish an individualized state of SPL equilibrium between the close proximity sound source and the distant sound source and thereby form a longitudinal y-z sound field along the z-axis of the sound space.

In the method of one embodiment of the present invention, the pair of speakers at close proximity to the listener's ears are held in place with a headband or similar means as in the form of a headphone device and have the pair of speakers disposed at equal distances away from their respective ears to provide air space between the ear and the speaker and have each speaker at equal angles to the pinna of their respective ears in order to diffract at an angle or directly into each ear canal the sound waves from the speaker or position an earphone type of speaker at each entrance to the auditory canal at an appropriate distance and angle so as to not seal the auditory canal or use headphone with perforations on its outer housings so ambient reverberation of the room and the direct sounds from the distant sound source may freely enter the auditory canals to form phantom sound images between the two speakers when a left/right stereo balance is established with the aid of SPL control means and thereby form phantom sound images in the frontal x-y axes field. The SPL of the two speakers of the close proximity sound source can be increased or decreased in unison with a separate SPL control means to equal that of the optimally preset SPL of the distant sound source in order to establish a state of SPL equilibrium between the two sound sources and thereby form a complete longitudinal y-z axes sound field along the z-axis of the sound space. The so formed longitudinal y-z sound field contains the identical sound images as those of the x-y axes lateral sound field except that the sound images in the longitudinal y-z axes sound field exist in dept along the z-axes of the sound space. With the aid of SPL control means, the listener is able to establish a state of SPL equilibrium between the two sound sources relative to the listener's location to the distant sound source at which point the lateral x-y axes sound field melds with the longitudinal y-z axes sound field and thereby create an x-y-z three-dimensional sound space of a phantom nature.

In the method of one embodiment of the present invention, each listener with independent SPL control means can: (a) increase or decrease the SPL of either left or right speaker of the close proximity sound source and thereby move the frontal x-y axes sound field and its sound images to the left or right of their previous location according to the principle of precedence; (b) can with a separate SPL control means increase or decrease in unison the SPL of the pair of speakers of the close proximity sound source to traverse along the z-axes the frontal x-y axes sound field and its sound images longitudinally towards or away from the listener according to the principle of precedence; and (c) can with such dual SPL control means maneuver the geometric x-z coordinate points of the sound fields laterally, longitudinally, diagonally or circularly and thereby move sound images to any point within the sound space according to the principle of precedence.

In the method of one embodiment of the present invention, the process of maneuvering sound images within the sound space can be accomplished much more rapidly and efficiently with digital electronic processing means instead of manually as previously described, with the exception of setting the left/right stereo balance between the pair of speakers of the close proximity sound source which needs to be manually set to meet the requirements of each listener, by encoding into the recording medium the SPL variations of each speaker's respective sound track during the initial recording stage or subsequently during the post-remixing process. The digital electronic processing can encode the audio signal to: (a) increase or decrease the SPL of either the left or right speaker of the pair of speakers of the close proximity sound source non-manually and thereby move the geometric x-y sound field to the left or right of their previous location according to the principle of precedence; (b) increase or decrease in unison the amplitude of both speakers of the close proximity sound source and thereby move the geometric x-z axes coordinate points of the sound images longitudinally towards or away from the listener along the z-axis formed between the close proximity sound source and the distant sound source according to the principle of precedence; and (c) therewith the coordinate points of the x-axis and the z-axis can be rapidly plotted with electronically programmed means to maneuver sound images laterally, longitudinally, diagonally, or circularly in the three-dimensional sound space. The movement of sound images within the sound space can be more effectively and rapidly moved from point to point to create a zooming or zipping sonic effect rapidly using digital electronic processing.

The zooming sonic effect so created can be incorporated and synchronized with a zooming video scene of afar to close-up or close up to afar to add greater realism to visual scenarios that depict such an audio/video situation. In addition, the zipping sonic effect so created may be incorporated and synchronized with video scenes that depict moments where high speed sonic effects such as of bullets, missiles, etc. require a zipping sound effect from point to point in a sound space to add greater realism to a scene where such sound effects are an integral part of a scenario.

With electronically programmed means, it would be possible for the two speakers at close proximity to the listener's ears can be caused to produce whisper soft dialogues and less audible sounds directly to the listener's ears while the normal louder sounds of a video scene are produced by the distant sound source. In addition, with electronically programmed means, the two speakers at close proximity to the listener's ears can be caused to produce loud startling fear inducing sounds to effect displeasure or discomfort to the listener while the sounds of the surrounding atmosphere are kept at a normal hearing level with the distant sound source. With the application of the aforementioned contrary sound effects, video scenes can be dramatically altered sonically to affect the viewer's reaction to the accompanying video actions.

These and other aspects and advantages of the present invention will become apparent from the following more detailed description, when taken in conjunction with the accompanying drawings which illustrate, by way of example, embodiments of the invention.

DETAILED DESCRIPTION OF THE PREFERRED EMBODIMENT

Figure 1A:
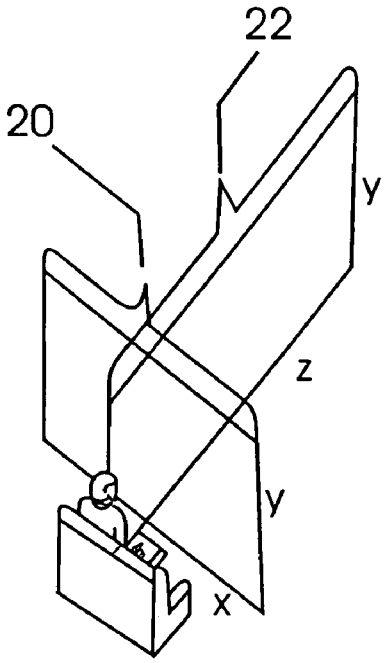
FIG. 1A shows a representation of a three-dimensional sound space having width (x), height (y) and depth (z) components.

Sound space, as with all natural three-dimensional space, is composed of width, height, and depth dimensions, commonly expressed in geometric terms as the x (width), y (height), and z (depth) axes components. These dimensional components, in particular, the sound fields along the x-y axis 20 and the y-z axis 22 of the sound space are illustrated schematically in FIG. 1A. Experiments in the three-dimensional sound space were conducted with the headphone described in U.S. Pat. No. 6,434,250 (the contents of which are hereby incorporated herein by reference in their entirety) to generate a more spacious sound field with depth dimension and to apply its capability to other related uses.

As used herein, the term three-dimensional sound space means the volume of space composed of the fundamental x, y, and z axis dimensions which form a sonically perceivable space with width, height and depth. The depth is a physically measurable dimension such as the distance between the close proximity and distant sound sources. The term sound field, as opposed to sound space, refers to an area of a plane having only two dimensions of the x and y axes, such as width and height. The term sound source may refer to a speaker. The term sound source image pertains to an object which produces a specific sound, such as a person or an instrument. A speaker is a sound source that produces any number of sound images. With reference to the accompanying illustrations, for visual clarity, only the two-dimensional sound fields of the x-axis and z-axis will be illustrated in the figures.

In combination with other speakers in various configurations, experiments were conducted with the headphone described in U.S. Pat. No. 6,434,250, in combination with other speakers in various configurations. Other headphones such as RADIO SHACK's Model 33-1176 which has a built-in left/right stereo balance control for each speaker may be used if modified to have angled speakers such that the speakers do not lie flat against the ear. In addition, a surround sound recorder such as the SONY's DVD model DAV-S300 or RADIO SHACK's Integrated Stereo Amplifier Model S-155 may be used to control the sound intensity for the headphones. Such conventional playback systems may be used, and specialized signal processing is not required for the sound effects in this embodiment of the invention.

The experiments demonstrated that both x-y left/right axes lateral sound field and the y-z, front/back, axes longitudinal sound field do exist in recorded sounds but the sounds being heard are flat, bi-dimensional and depthless in its sonic effect when the speakers are incorrectly configured or their SPL cannot be properly balanced between and among the speakers to establish states of SPL equilibrium relative to a listener's location which are required to create the x, y, and z axes of a three-dimensional sound space in which sound images can locate themselves or move about.

The behavior of sound effects is governed by the laws and principles of sound physics, in particular the Law of the First Wavefront and the Haas Principle of Precedence. The Law of the First Wavefront and the Haas Principle of Precedence infer that when sounds from two sources containing similar sound contents with equal intensity and the two sources are positioned to form an equilateral triangle with the listener, the sound effect for the listener would be the formation of another sound source of a phantom nature midway between the two real sources as a consequence of summing localization along the lateral left/right axis to the listener. This inference would also apply to two sound sources, such as headphones, longitudinally aligned along the front/back z-axis of a three-dimensional sound space.

Other elements involved in the creation of the x, y and z axes of a three-dimensional sound space include the proper geometric configuration of a minimum number of speakers, and the use of SPL control means to make proper SPL adjustments to establish states of SPL equilibrium between and among speakers relative to a listener's location to the speakers. A solid, phantom three-dimensional sound space may be created with the proper placement of the speakers with appropriate adjustments to the intensity of the sound produced therefrom, in accordance with the inference discussed above and the application of psychoacoustics.

The Law of the First Wavefront and the Haas Principle of Precedence; the proper speaker configuration; and the use of SPL control means; are interrelated. Using these interrelated factors, one can develop a lateral left/right x-y axes sound field and a longitudinal front/back y-z axes sound field to form an x-y-z three-dimensional sound space, and meld them together to form a phantom three-dimensional sound space within which phantom sound images can suspend themselves or move about in three dimensions. While specialized signal processing may be used to create a phantom three-dimensional space, it is not necessary in the preferred embodiments of the invention.

The preferred embodiment of the present invention uses headphone speakers located in close proximity to the listener, and a central speaker located relatively distant from the listener. This format uses close proximity (CP) and distant sound (DS) sources, and this format may be referred to herein as the CP/DSS format for purposes of brevity.

This speaker configuration increases the number of sweet spots available to a listening audience by forming individualized wedges of sound spaces composed of at least three speakers which create stable independent three-dimensional sweet spots for each listener in an audience. Other multi-speaker surround sound formats create one large sound space with a few stable sweet spots. Only a few listeners in a large general audience would benefit from these limited audio sweet spots in the general sound space. Such formats do not create the individualized sound spaces of the present invention.

Figure 2:
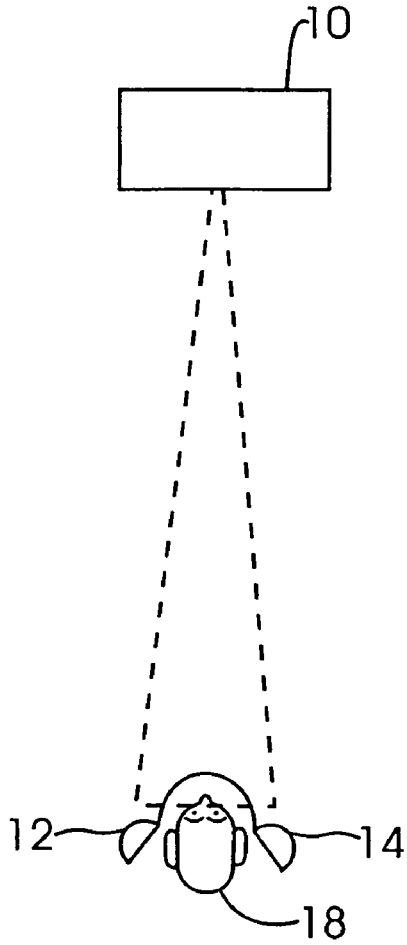
FIG. 2 is a schematic view of the placement of two headset speakers and a distant central speaker in accordance with an embodiment of the present invention.
Figure 1B:
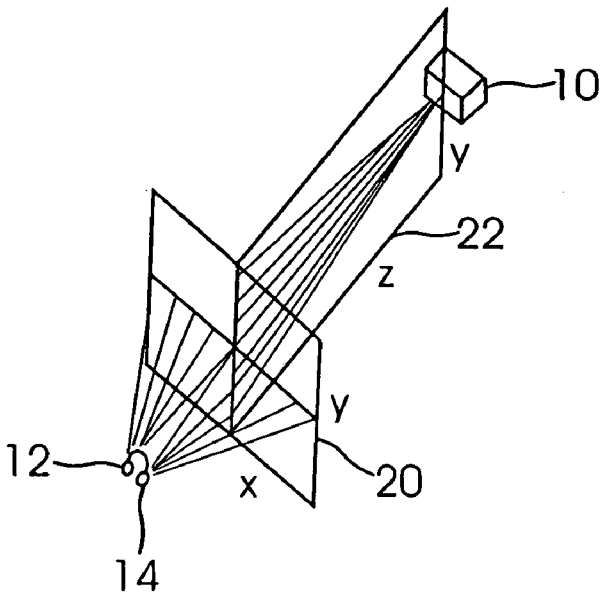
FIG. 1B shows a representation of a three-dimensional sound space having width (x), height (y) and depth (z) components produced by a central speaker and headset speakers in accordance with an embodiment of the invention.

The CP/DSS format creates a phantom three-dimensional sound space using a minimum number of speakers to form two sound sources with which to develop a longitudinal y-z axis sound field 22. Three speakers 10, 12 and 14 form the two sound sources. One sound source comprising two headset speakers 12 and 14 are located at close proximity to the listener. The other sound source is a central speaker 10 located a further distance from the listener. This is generally illustrated in FIGS. 1B and 2. The speakers 10, 12 and 14 are preferably driven by non-binaural sound signals. Preferably the signals driving the left and right headset speakers 12 and 14 are delayed relative to the signal driving the central speaker 10. Although not necessary, signals for sounds below 250 Hz can be transmitted to the headset speakers. A separate subwoofer may also be provided and placed anywhere in the room to deliver low frequency sounds to the listener audience. The headset speakers 12 and 14 are preferably located within centimeters or less of the listener's ears, while the central speaker is preferably located several meters or more away from the listener. The central speaker 10 is employed as a community sound source which is shared in common by all the listeners. As illustrated in FIG. 2, the three speakers 10, 12 and 14 are disposed to form an isosceles shaped triangular sound space dedicated to each individual listener 18.

Figure 3B:
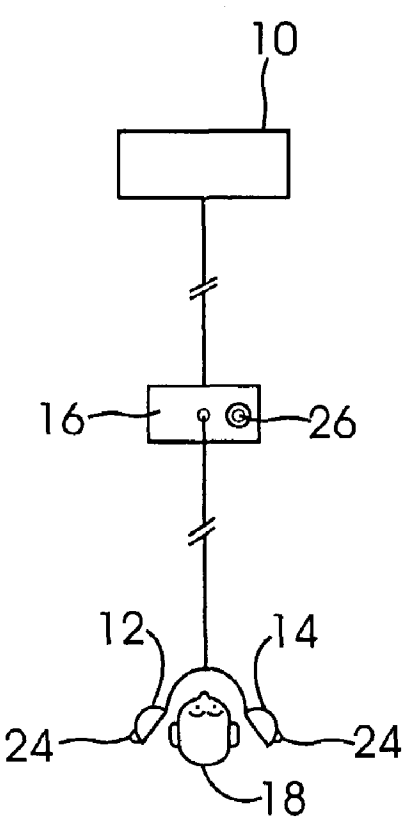
FIG. 3B is a schematic view of the SPL control means of another embodiment of the present invention.
Figure 3A:
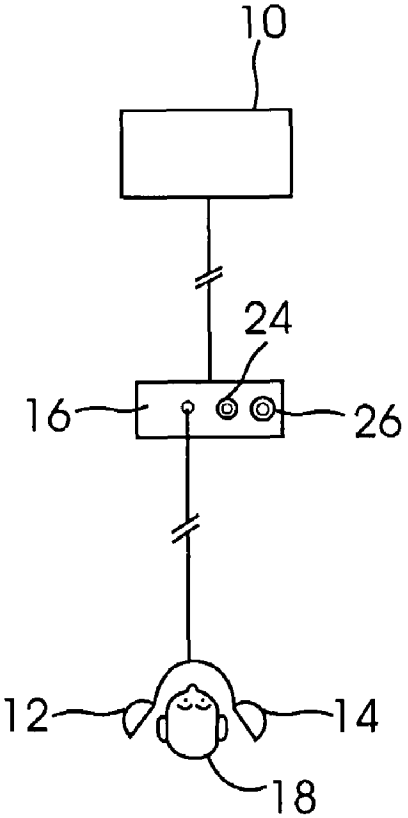
FIG. 3A is a schematic view of the SPL control means of one embodiment of the present invention.

Individual SPL control means 16 allows each listener 18 to establish a state of SPL equilibrium between and among the speakers to develop individualized sound space. As illustrated in FIGS. 3A and 3B, the SPL control knob 24 is used to establish stereo balance between the two speakers at close proximity to the listener. The SPL control knob 24 illustrated in FIGS. 3A and 3B may also be used to make adjustments to compensate for differences in hearing acuity between the listener's two ears due to a hearing deficiency. The SPL control knob 24 may be used to vary an individual listener's perception of presence laterally along the x-axis. A head or neck band or ear loop or other means may be used to hold in position the two speakers 12 and 14 at close proximity to maintain constant the sweet spot for the listener 18 notwithstanding physical movement by the listener 18. As illustrated in FIG. 3A, a separate control box 16 may be provided for each listener to control both the left/right stereo balance and the movement of the sound field longitudinally along the z-axis using control knobs 24 and 26, respectively. In the alternative, the SPL control knob 24 may be incorporated into the headset speakers 12 and 14 to allow the listener to manually control and balance the sound intensity of the left and right headset speakers 12 and 14, as illustrated in FIG. 3B.

One embodiment of the SPL control means 16 is illustrated in FIG. 3A. A left/right stereo balance control knob 24 is used to adjust the SPL of headset speakers 12 and 14. A front/back z-axis control knob 26 is used to adjust the SPL of the speakers 12 and 14 in unison. In an alternative embodiment illustrated in FIG. 3B, the SPL control knob 24 could also be embodied in the headset itself for adjusting the SPL of the headset speakers 12 and 14. The front/back z-axis control knob 26 may be provided on a separate SPL control box for adjusting the SPL of the speakers 12 and 14 in unison.

The sound images can also be maneuvered in three-dimensional space during the post-recording mixing stage. Such sound effects would be provided without the manual interaction of the listener. It is not necessary to use a head response transfer function (HRTF), or cross-talk cancellation with the preferred embodiment of the present invention. The speakers are preferably driven by non-binaural sound signals.

The total sound space created by the CP/DSS method may be termed as being of a bisonic nature in that the bisonic sound space is formed, as compared to binaural, when the near field sound attributes of the close proximity sound source and the sound attributes of the reverberant sound field of the distant sound source meld at a state of SPL equilibrium between the two sound sources. When the two sound fields with differing attributes combine, they form an amalgam of a sound space containing both sonic attributes which results in a unique sound quality not possible with other common surround sound or virtualized formats.

The close proximity sound source is composed of a pair of speakers in which one speaker produces the sounds of the left channel and the other speaker produces the sounds of the right channel of an electronic playback system. Both speakers are situated at close proximity to the listener's respective left and right ears, but each respective ear is not isolated such that external sounds are allowed to impinge upon the pinna of each ear. Preferably, the left and right headset speakers 12 and 14 are held in place at equal angles to the pinna of each respective ear, as shown in FIG. 2. A third speaker is located at a greater distance from the listener to produce the sounds of the center channel of the same playback system.

Two headset speakers 12 and 14 are positioned to form the base of the isosceles triangle, with the third speaker 10 located at the apex of that isosceles triangle. The two speakers 12 and 14 at the base of the triangle are positioned at close proximity to the listener's ears with a headphone-like device and the third speaker 10 is located at its apex at an appropriate distance from the pair of close proximity speakers 12 and 14. The three speakers 10, 12 and 14 are disposed in longitudinal alignment with the listener and form a generally isosceles triangle. The three speakers 10, 12 and 14 function as two sound sources instead of three separate speakers, with headset speakers 12 and 14 functioning as one source.

The disposition of the three speakers in the configuration described is important to the development of a sound space which contains two different forms of sound attributes of similar sound content from two sound sources, with the pair of close proximity speakers producing sound clarity and details associated with near field listening, and the distant speaker providing all the sound attributes of a distant sound source including the ambient room contributions of reverberations, reflections, echoes and other sound elements of the room, all of which are essential to the creation of a more accurate and transparent sound scape as they were in the pre-recorded sound space.

In contrast to the common surround sound format of five or more speakers, and the traditional two-speaker equilateral triangle stereo setup (where only the listener is located at the apex of the triangle, and the audio sweet spot may be located away from the listener), the preferred embodiment of the invention, as illustrated in FIG. 2, employs at least three speakers for each listener. As shown in FIG. 2, the three speakers are configured in an isosceles shape triangular layout with a speaker located at each of its three vertexes. The base of the triangle with its two speakers 12 and 14 is located at close proximity to the listener and the third speaker 10 being located at the more distant apex to produce a speaker configuration that is a reversal of the traditional two-speaker equilateral stereo triangle.

The reason for reversing the disposition of the speakers and the addition of a third speaker to the triangle is the key to the ability of this CP/DSS format to develop the essential z-axis of the depth dimension. With the two speakers at the base of the triangle being situated at close proximity to the listener's ears and the third speaker being positioned at its apex and longitudinally aligned with the listener, this speaker configuration provides the two sound sources between which summing localization can be developed to form a longitudinal sound field along the z-axis by establishing a state of SPL equilibrium between them relative to the listener's location to the distant sound source. The lack of a state of SPL equilibrium between the two sound sources keeps them apart as independent sound fields. Unless they are fused together, the z-axis for the depth dimension will be absent from the total sound space.

Based on the same principle of forming a lateral point of summing localization according to The Law of the First Wavefront and the Precedence Effect as between the two speakers of an equilateral triangle stereo format, a longitudinal front/back point of summing localization can be developed between the close proximity and distant sound sources with the aid of SPL control means to establish the necessary state of SPL equilibrium between them.

Another important reason for reversing the disposition of the three speakers and employ just one speaker for the distant sound source is to remove the cross-talk dilemma between the speakers and problems related to HRTFs and sweet spots sensitivity that is prevalent with traditional two-speaker stereo setups. By locating two of the three speakers at close proximity to the listener's ears and clamping them to the head with a head or neck band or with other appropriate means, the point of lateral summing localization along the x-axis formed between them remains constant despite the listener's unintentional physical movement and minimizes the undesirable sound effects due to the laws and principles of sound physics, which renders this configuration some degree of mobility. One suitable headset speaker configuration is described in U.S. Pat. No. 6,434,250.

The reasons for a third speaker and its being situated at the distant apex of the isosceles triangle are three-fold. First reason is to have it reproduce the sound signals of the center channel and also function as a distant sound source where the principal sound activities occurs and to have it work in concert with the close proximity sound source to develop the z-axis of a three-dimensional sound space. The second reason for using just one speaker as a distant sound source instead of multiple speakers, although other speakers may be employed to create special effects, is to eliminate the vagaries of sweet spot sensitivity as well as crosstalk confusion and skipping effects between speakers, common to multi-speaker surround sound formats which can compromise the quality and wholeness of the sound space. The third reason is to have it function as a performance stage and anchor the primary sound activities at a specific location as well as act as a community sound source which is shared in common by all listeners.

The CP/DSS format is contrary to that of the multi-speaker surround sound formats regarding the preferred number of speakers used to develop a believable phantom sound space. The multi-speaker formats maximize the number of speakers employed from five (e.g., the 5.1 format), six, seven, and even ten (and possibly even more speakers than the ten speakers of a 10.2 format). A 5.1 sound system set-up having five speakers forming a confined audio sweet spot which may not be located where the listener is. The CP/DSS format, on the contrary, minimizes the number of speakers to three which is the logical number by reason of the applicable laws and principles of sound physics and for functional reasons for this format. Using a great number of speakers, as in forming an immersive sound space, adds to the "confusion" of its total sound space because it imposes on the listeners as many segments of two-dimensional lateral sound fields as there are number of speakers which condition is prone to producing poor and confusing stereo effects and less sound transparency. The ear-brain faculty can be confused to determine which two sound fields of the many form the best stable stereo effect and the listener wonders which two speakers is being heard or should be listened to. The listener attempts to compensate with one's imagination, but questions whether the third dimension is really there. The CP/DSS format removes the "confusion" by employing merely two sound sources with the use of only three speakers which are properly deployed to develop a stable and unambiguous sweet spot with sonic transparency which do not require the listener's imagination to concoct. With the CP/DSS format, the third dimension of a sound space is present, albeit in phantom form. The CP/DSS format can create the essential z-axis sound field which multi-speaker formats are unable to do.

The ability of this CP/DSS format to create a phantom three-dimensional sound space when compared with other multi-speaker systems is that its concept is based principally on tenets of sound physics; namely, the Law of First Wavefront and the principles of precedence. Experiments were conducted to study the concept for the present invention which indicated that the speakers should provide two sound sources which are longitudinally and laterally aligned with a listener; a minimum of three speakers should be disposed in a generally triangular configuration to produce a close proximity and a distant sound source; and that each listener should be provided with SPL control means to be able to make independent SPL adjustments between and among the three speakers to create an individualized three-dimensional sound space for each listener. This allows the listener to create both lateral x-y axes sound field and longitudinal y-z axes sound field with aid of proper SPL control means and meld them together. Headphones and SPL control means should be used for each listener to develop an individualized sound space and customize its sound effects to one's preference and needs. Each listener should be provided with the use of SPL control means to enable one to vary one's choice of perception of presence to the sound stage.

The preferred embodiment of the invention employs a minimum number of speakers and deploy them to create two separate sound sources, one at close proximity to the listener and another sound source at a farther distance from the listener. Based on experiments conducted to meet these needs, the most appropriate and effective method is to deploy a minimum of three speakers in a generally isosceles shaped triangular layout with one speaker located at each of its three vertexes. The two speakers at the base of the triangle work in unison and function as one sound source, and the third speaker is situated at the apex of the triangle and acts as the second sound source. The two speakers at the base of the triangle are positioned at close proximity to the listener's ears and the third speaker is aligned longitudinally with the listener by virtue of being positioned at the more distant apex of the triangle. This third speaker is shared in common as a community sound source by all listeners as done in all surround sound formats.

The preferred embodiment of the CP/DSS format of the present invention is the provision of the SPL control means for each listener in a group of listeners to make independent SPL adjustments to the two speakers at close proximity to the listener's ears in order to set the left/right stereo balance to form lateral phantom sound images between the two headset speakers, and with a separate SPL control means is provided for the listener to adjust in unison the SPL of both speakers to establish a state of SPL equilibrium with that of the distant third speaker whose SPL is preferably preset at an optimal level. When a state of SPL equilibrium is established among the three speakers, an individualized isosceles shaped triangular sound space is formed for each listener.

The preferred embodiment of the invention forms both lateral x-y axes and longitudinal y-z axes sound fields which contain their respective phantom sound images and to meld both sound fields into the individualized x-y-z axes of a three-dimensional sound space. Experiments with this CP/DSS format have shown that both lateral x-y, left/right, axes sound field and the longitudinal front to back y-z axes sound field are present in a recording's total sound space and that they can be properly repropagated to produce believeable three-dimensional sound space as in their original pre-recorded state. Present surround sound and other formats are incapable of doing this. This format resolves this problem by employing two independent sound sources with similar sound contents which are appropriately spaced apart and longitudinally aligned with the listener and the use of individually assigned SPL control means.

This format's solution to creating the two essential sound sources, as described above, is to deploy three speakers in an isosceles shaped triangular layout in which two of the speakers at the base of the triangle function as one sound source and the third speaker is located at its distant apex and acts as the second sound source. The importance of this isosceles triangular layout of speakers is that by locating the two speakers at the base of the triangle at close proximity to the listener's ears and the third speaker at its more distant apex automatically aligns the listener and the close proximity speakers longitudinally with the speaker at the apex and so form two individual sound sources set apart at an appropriate distance.

With the two sound sources set apart and with the absence of SPL equilibrium between them, there is a vacant space between them with no phantom images although sound waves are fully present. This is so because phantom images are formed when the sounds of two sound sources with similar sound contents and appropriate room contributions meet at a point of SPL equilibrium where the phenomenon of summing localization occurs which in this format is dependent on the listener's location to the distant sound source and the sound level of each sound source, provided there is no phase time differences between them which if present can be corrected with delay means or other appropriate methods. This means that the listener will hear either the sound of the close proximity sound source or that of the distant sound source depending on which of the two sounds is louder, according to the principle of precedence.

However, if the SPL of both sound sources are caused to be equal relative to the listener's location to the distant sound source, a state of SPL equilibrium develops according to The Law of the First Wavefront and the Precedence Effect at which point phantom sound images are formed in the longitudinal sound field along the z-axis between the close proximity and the distant sound sources. This development of phantom images in the longitudinal sound field between the two sound sources along the z-axis is identical to the principle of creating phantom images between two frontal laterally positioned sound sources as with the equilateral triangle stereo setup except that in this case the phantom images are formed in the longitudinal sound field because the two sound sources are aligned along the z-axis instead of the x-axis. With this format's CP/DSS disposition of three speakers and the use of SPL control means, the bases for forming both lateral x-y axes and longitudinal y-z axes sound fields have been formulated.

Figure 4A:
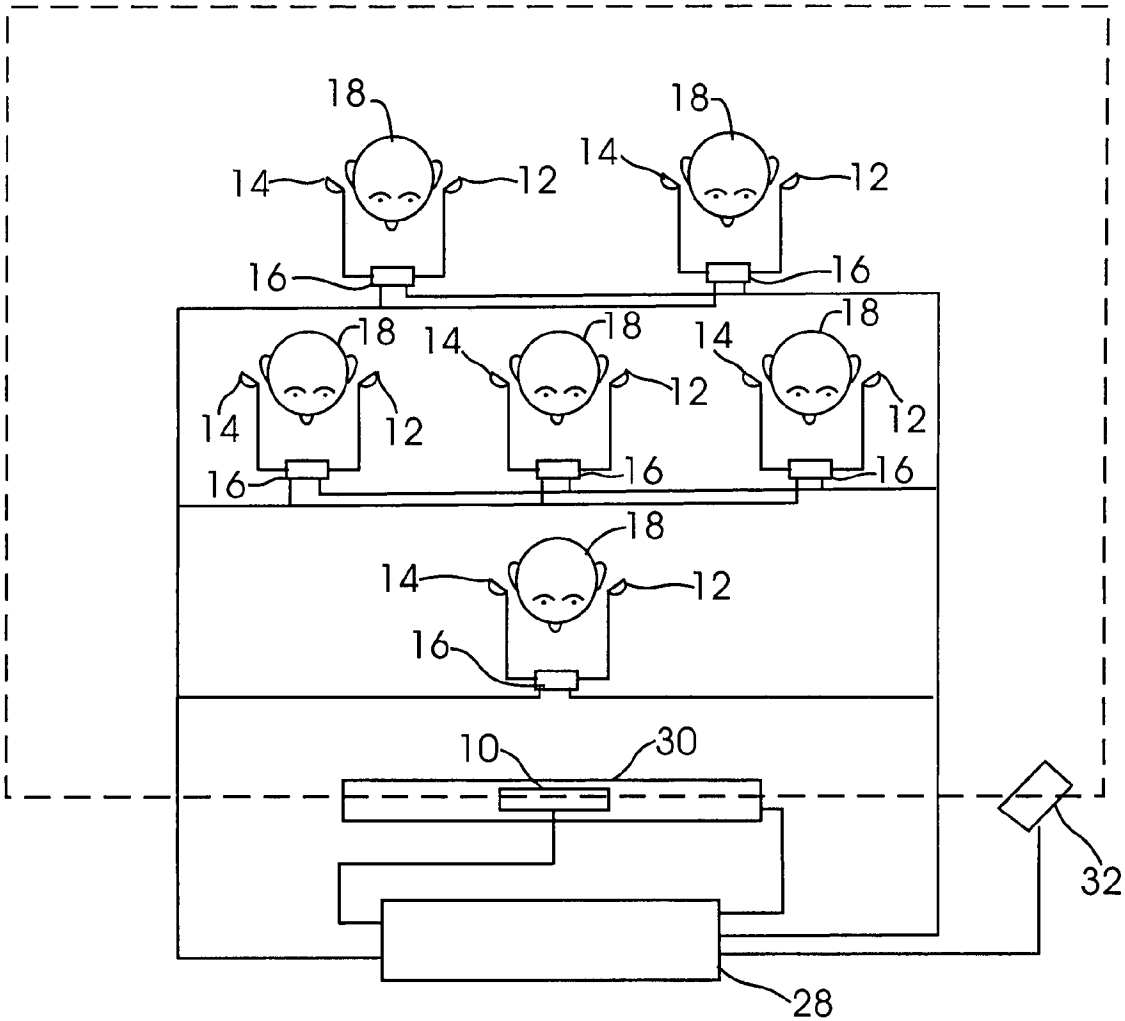
FIG. 4A is a schematic view of the placement of several pairs of headset speakers for an audience of listeners, a distant central speaker, and a subwoofer speaker, in accordance with an embodiment of the present invention.
Figure 4B:
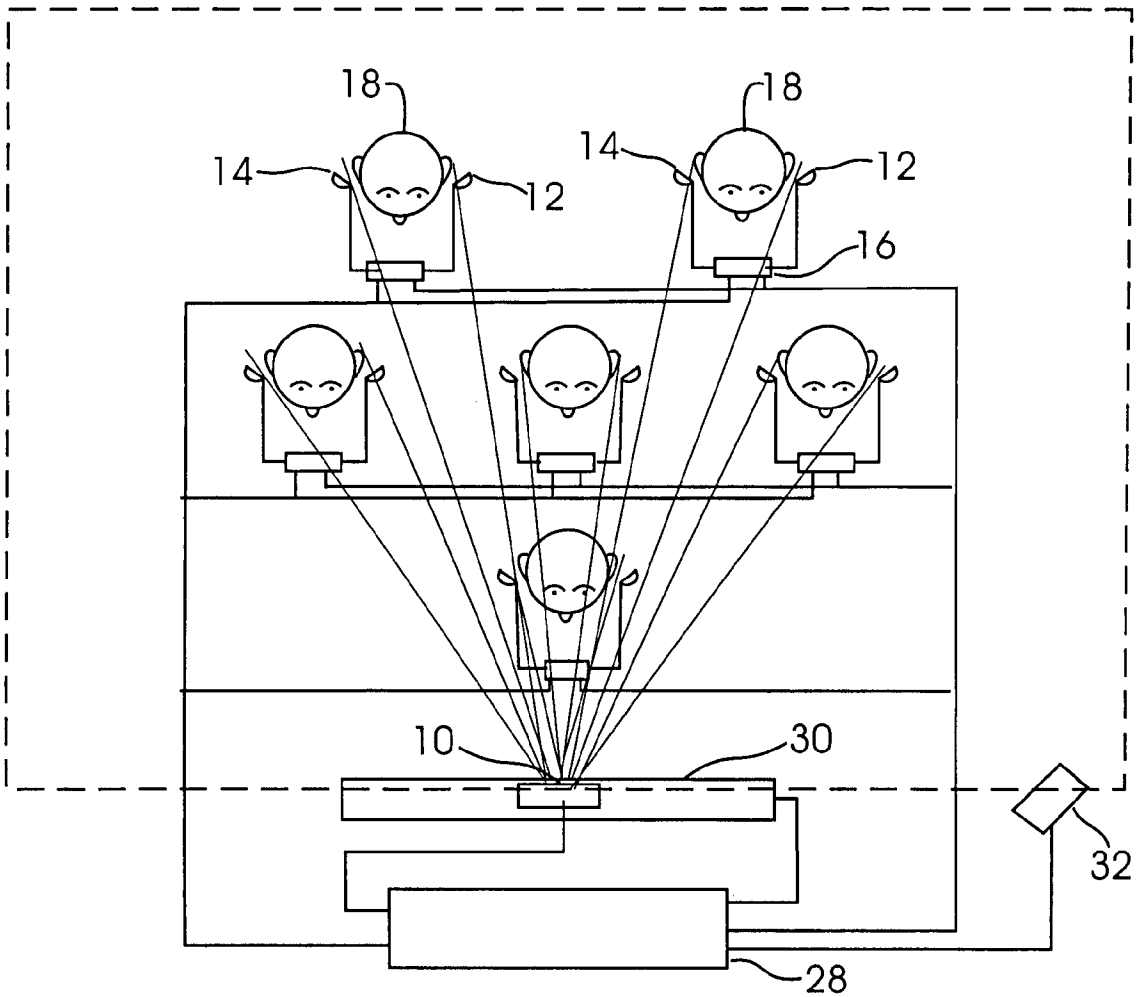
FIG. 4B is a schematic view of sound spaces created by several pairs of headset speakers for an audience of listeners, a distant central speaker, and a subwoofer speaker, in accordance with an embodiment of the present invention.

One of the features of this CP/DSS format is the use of headphones or earphones or similar forms of listening devices to create individualized three-dimensional listening sound space for each listener in a group of listeners who are listening to the same recorded sounds. A preferred embodiment of the present invention for an audience of listeners 18 is schematically illustrated in FIG. 4A. Each listener has a personal set of headset speakers 12 and 14, and an individual SPL control means 16 for controlling the SPL of each individual set of headset speakers 12 and 14. This preferred embodiment of the invention further includes an audio/video playback machine 28, such as a DVD player, connected to a television 30 or other video display. A subwoofer speaker 32 may also be provided for reproducing low frequency sounds. The positioning of the subwoofer speaker is not critical, and can be located anywhere in the room. With the use of a headphone in combination with the distant sound source, which, as mentioned earlier, is a community sound source shared in common by all the listeners, the individualized sound space is bounded in a space formed by the two speakers at close proximity to the listener's ears and the distant sound source which forms a narrow wedge of sound space in the shape of an isosceles triangle, which is schematically illustrated in FIGS. 2 and 4B. The total number of individualized sound space of the entire listening audience is composed of as many of these sound space wedges as there are numbers of listeners with headphones, as illustrated in FIG. 4B, rather than one whole sound space in which all the listeners share in common as done in multi-speaker surround sound formats.

To form an individualized wedge of listening sound space, each listener 18 uses sound SPL control means 16 to establish the left/right stereo balance to form phantom images in the lateral sound field between the two speakers at close proximity and increase or decrease the SPL of both close proximity speakers in unison to equal the preset sound level of the distant sound source to develop a state of SPL equilibrium between them at which point an individualized phantom three-dimensional sound space is formed.

A preferred embodiment of the invention further includes a video signal decoder for receiving a video signal for displaying a video image. The sound signal can be synchronized with the video signal such that the sound pressure level of the left and right speakers is increased when the displayed video image is zoomed in from the listener's perspective. The video signal and the sound signal could also be synchronized such that the sound pressure level of the left and right speakers is decreased when the displayed video image is zoomed out or away from the listener's point-of-view. The sound pressure level of the left and right speakers relative to the central speaker is automatically adjusted to achieve a phantom three-dimensional sound space according to changes in the point of view represented in the displayed video image.

The Use of Headphones

A headphone or a similar listening device with at least two speakers which does not press flat against the ears and encapsulate them is important to the effectiveness of the CP/DSS format. With three speakers disposed at their proper locations to form an isosceles triangle, developing the required phantom sound images at close proximity to the listener's ears can be accomplished preferably with the use of a headphone set with angled speakers such as described in U.S. Pat. No. 6,434,250, (the contents of which are incorporated herein by reference in their entirety), or any type of headphone which permits the free entrance of sounds from external sound sources to impinge upon the pinna of the ears before they enter the ear canals. Such headset speaker units are located adjacent to the auricle of the listener's ear without covering or obscuring the ear. These types of headphones permit the outer ear to be involved in the modulation of sound frequencies from each sound source and the ambient elements of the room and facilitate their reconstitution to their original state before they enter the ear canals. The speakers may be oriented at any angle to the ear canals, even from the rear of the head, to develop phantom sound images including images in the middle of the head.

The headset speaker assembly is oriented at an angle to and spaced from the auditory canal, rather than being generally in line therewith when the assembly is in place on the ear of the listener as is commonly found in conventional headset designs. The speaker units may be positioned at optimum angles of incidence relative to the auditory canals of a listener such that the sound waves will diffract into the auditory canal. Projecting stereo sound waves from the speaker units to the ears of a listener at an optimum angle can achieve heightened image realism. By increasing or decreasing the angle of the speaker units relative to the listener's ear, the horizontal spatial dimension of the stereo sound may be narrowed or spread. Providing adequate distance between the speaker assemblies and the listener's ears can also heighten sound and imaging accuracy.

The airspace between the ears and the speakers, or any form of free entrance of external sounds to impinge upon the pinna of the ears, is an important requirement of this format because it is in this space that the sound clarity of near field listening associated with headphones and the diffused direct sound from the distant speaker as well as sound elements of the reverberant sound field reconstitute to form a totally reformed sound before it enters the ear canals.

Figure 5:
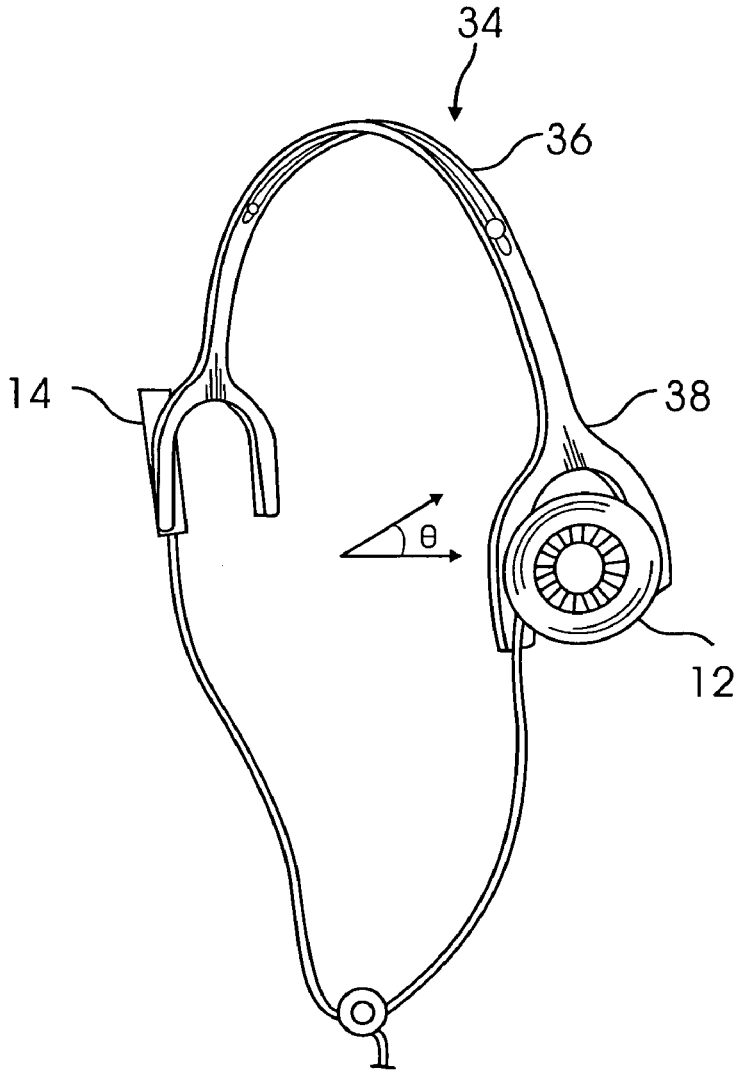
FIG. 5 is a perspective view of the headset speakers used in an embodiment of the present invention.

FIG. 5 shows a headset 34 having a headband portion 36, slidably adjustable to generally fit over the head of a listener. The headband portion 36 connects to a pair of generally anterior and posterior arms 38 designed to fit over the ears on the head of a listener, between the pinna and the head on each side. The headset speaker units 12 and 14 are attached to the anterior arms 38 of the headset at an angle θ relative to the plane of the ears of a listener, which plane parallels an imagined vertical plane bisecting the head of a listener into symmetrical halves. A retention element such as a slidable friction holder may be used to keep the headset speaker units 12 and 14 from moving out of position.

The use of headphones for this format is a departure from that of the multi-speaker surround sound layouts in that its use in conjunction with the distant speaker provides the essential speaker configuration to form individualized sound space for each listener. This capability using headset speakers to form individualized sound spaces increases by many folds the number of sweet spots available to an audience listening to the same recorded sound, which is illustrated schematically in FIG. 4B. The use of headphones is also advantageous in that with the aid of SPL control means, a listener may make corrective adjustments to either speaker to compensate for hearing deficiencies which if not corrected can compromise the listener's desired sound effects.

By being anchored in position to the listener's head and with the aid of SPL control means, the headphone plays a key role in holding constant the phantom images between the two speakers at close proximity to the listener's ears despite physical movements and so lessens the problem of sweet spot sensitivity. This capability gives a listener far greater freedom of physical mobility than the equilateral triangle stereo arrangement while still maintaining the phantom images in place which is not possible with other multi-speaker formats. The unpleasant condition of vanishing phantom images is common with multi-speaker surround sound formats which form their phantom images between two of several distant fixed-in-place sound sources based on the principle of the two-speaker equilateral triangle stereo layout. The fixed-in-place-distant-speaker-only format is sweet spot sensitive and so limits the number of sweet spots available to the entire listening audience and is unfair to those who are located out of the sweet spot area.

The fixed-in-place-distant-speaker-only format, in contrast to this CP/DSS format, is sweet spot sensitive because there are insufficient numbers of stationary speakers to create a multitude of sweet spots to accommodate each listener in every location of a listening audience. Besides it would be impossible for each listener to make the proper sound level adjustments between the many speakers to create individualized sound space with the fixed-in-place-distant-speaker-only surround sound format. This CP/DSS format, in comparison, provides each listener in the audience the required two speakers at close proximity and a third speaker, the community sound source to produce an individualized sweet spot and with the use of independent SPL control means to develop the essential state of SPL equilibrium between and among the close proximity and distant sound sources.

By being able to hold the speakers in an unvarying distance and angle to the ears, the use of headphones assures compliance with the Law of the First Wavefront and the Precedence Effect to maintain in constant balance the stereo effect between the left and right channels for each listener in every location of the audience, which is not possible with the multi-speaker surround sound formats which means that every member of the audience does not hear the same intended sound effects as they should.

As can be seen from the preceding description, the use of headphones, or comparable forms of hearing devices, is an important factor to the effectiveness of this CP/DSS concept.

This concept of using headphones for this format can also be applied advantageously even to live performances in which the z-axis sound field naturally exists. By applying the same law and principle of precedence as with recorded sound playback systems and with the addition of electronic transmission devices to transmit sounds directly by wire or wireless means the on stage sound activities to a listener's headphone, a listener may vary one's sense of presence to the live stage or location in the audience by applying the principle of precedence with the aid of SPL control means as described previously.

The application of headphones in this CP/DSS format is also beneficial to a recording engineering during the recording or remixing stage of recordings by providing sonic nuances of near-field clarity and details not recognizable under other recording conditions. Also, the use of the fundamentals of this CP/DSS format gives the recording engineer greater possibilities with which to incorporate into the recorded total sound space more details and sound effects with three-dimensional spatial accuracy than is possible with other recording methods.

In addition to being used to create three-dimensional sound space, headphones produce near-field clarity and sonic details due to its closeness to the listener's ears that is also useful for creating and directing soft and intimate dialogue and less audible sounds to each listener in an audience to effect a one-on-one relationship between the viewer and the performer of such a movie scene. The opposite of such soft sonic effect of loud, startling, fear inducing sounds can also be directed directly to a listener's ears with the use of headphone of the CP/DSS format. In both instances, the other sounds of the sound space are produced at a normal level by the distant sound source.

Both forms of sound effect can be created with properly programmed electronic means to produce the necessary SPL variations between the close proximity and distant sound sources. The ability of this CP/DSS format to create these two contrary sound effects illustrates its bisonic nature and the use of a headphone to create sound effects which are not possible with other formats.

The Experiments

As mentioned earlier, this CP/DSS format principally relies on The Law of the First Wavefront and the Principles of Prescedence which are well defined, understood and incircumventable. Therefore, the experiments conducted were directed to the other requirements of making this format functional and practical.

The experiments prove that developing a phantom three-dimensional sound space requires the accurate application of the laws and principles of sound physics in conjunction with the correct geometric disposition of the right number of speakers and the need of SPL control means to manipulate the sonic level of each speaker to develop the proper equilibrium between and among the speakers. These strict requirements are quite different than the comparatively loose requirements of the multi-speaker surround sound formats in which its object is to create an immersive sound field which, by definition, is not a three-dimensional sonic space. The immersive sound field is composed of a conglomeration of lateral bi-dimensional x-y axes sound fields which lack the indispensable z-axis longitudinal sound field, wherein lie the cause of its flaws.

Of the various speaker combinations and configurations experimented with for this CP/DSS format, one experiment produced an unexpected but undeniable evidence of three-dimensional sonic effect.

This one experimental combination of speakers was done with a primary sound source in the form of a portable radio-tape-player stereo set which was modified to produce sounds of both radio speaker and a headphone simultaneously which was connected to the radio by wire. The headphone was provided with SPL control means to establish left/right stereo balance between the two speakers and a separate SPL control means to increase or decrease their sound level in unison. This combination was based on curiosity as to what the resultant sound effect might be rather than on knowledge of what effect to expect, which is an unexpected discovery.

In the process of testing this combination of one sound source at close proximity to the listener's ears, the headphone, and the second sound source, the radio, situated at a farther distance of about ten feet, a very unusual sonic effect was audible. As the sound level of the headphone was varied while the sound of the radio speaker was held at a constant level, the presence effect to the sound stage, the radio, could be advanced towards or retreated from the listener's location according to the dominant loudness of either sound source—a clear evidence of the Haas principle of precedence at work. The salient fact of this finding is that at the point where the sound levels of both sound sources attained a state of equilibrium, a complete longitudinal sound field was developed along the z-axis between the two sound sources and summing localization occurred and phantom sound images were formed. This summing localizing is similar to that which develops between the two speakers of an equilateral triangle stereo arrangement except that in this case the summing takes place along the z-axis. The ability of the CP/DSS format to create a longitudinal sound field along the z-axis is the sought-after "missing link" to the development of a believable phantom three-dimensional sound space with recorded sounds.

As described above, the experiments indicate that in the creation of phantom three-dimensional sound spaces, the most effective method, in addition to complying with the laws and principle of sound physics, is to deploy a minimum of three speakers to form a close proximity sound source and a distant sound source and align them longitudinally with the listener. They also show that the most effective and functional method to form both sound sources and align them longitudinally with the listener is to deploy a minimum of three speakers in a generally isosceles shaped triangular layout with a speaker positioned at each of its three vertexes facing the listener. The two speakers at the base of the triangle are located at close proximity to the listener's ears, as with a headphone, and the third speaker is situated at the more distant apex. These two sound sources are longitudinally aligned with the listener by virtue of having the headphone attached to the listeners head at the base of the triangle and the distant speaker locating its apex thereby automatically aligning the three points, the listener, the close proximity and the distant sound source, as illustrated in FIG. 2.

As done in the experiments, the sounds of the close proximity sound source, the headphone set, and those of the distant sound source, the speaker at its apex, can be melded by developing a state of SPL equilibrium with the proper use of SPL control means. By melding the sound fields of both sound sources, the lateral x-y sound field of the close proximity sound source and the longitudinal y-z sound field, and z-y-z sound space is formed. As discussed earlier, FIG. 1B schematically illustrates the formation of sound fields along the x-y axis 20 and the y-z axis 22.

Figure 6:
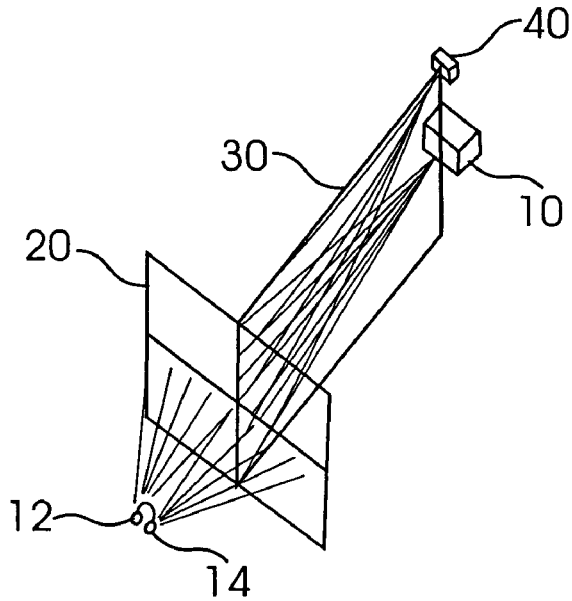
FIG. 6 shows a representation of a three-dimensional sound space having width (x), height (y) and depth (z) components produced by a central speaker, a secondary elevated speaker, and headset speakers in accordance with an embodiment of the invention.

The experiments also show that this three-speaker format works best with sound activities that take place in the frontal first and second quadrants of a sound space. If sound effects in the rear third and fourth quadrants are desired, additional speakers may be utilized behind the listener. Certainly, other speakers may be employed for special effects. For example, as illustrated in FIG. 6, an additional speaker 40 placed above the central speaker 10 may be used to alter the sound effect by increasing the height of sound images along the y-axis. However, the basic three speakers which form the isosceles shaped triangular layout is the key element of this CP/DSS speaker layout.

Plotting the Movement of Sound Images

The stereo balance between the two speakers of the close proximity sound source can be swayed to the left or right of the listener along the frontal x-axis as well as towards or away along the longitudinal z-axis between the close proximity and distant sound sources according to the Principle precedence. With this unique and important combination of movements, sound fields and their sound images can be traversed from point to point anywhere in the frontal phantom sound space during the remixing stage of a recording.

In the absence of the z-axis in the remixing process, the mixer has no point of reference to the depth of a sound field and so often mislocates sound images in the third-dimension. This condition is not noticeable when one listens to recordings in two dimensions but it is very discernable when the same recording is heard in three dimensions.

Figure 7:
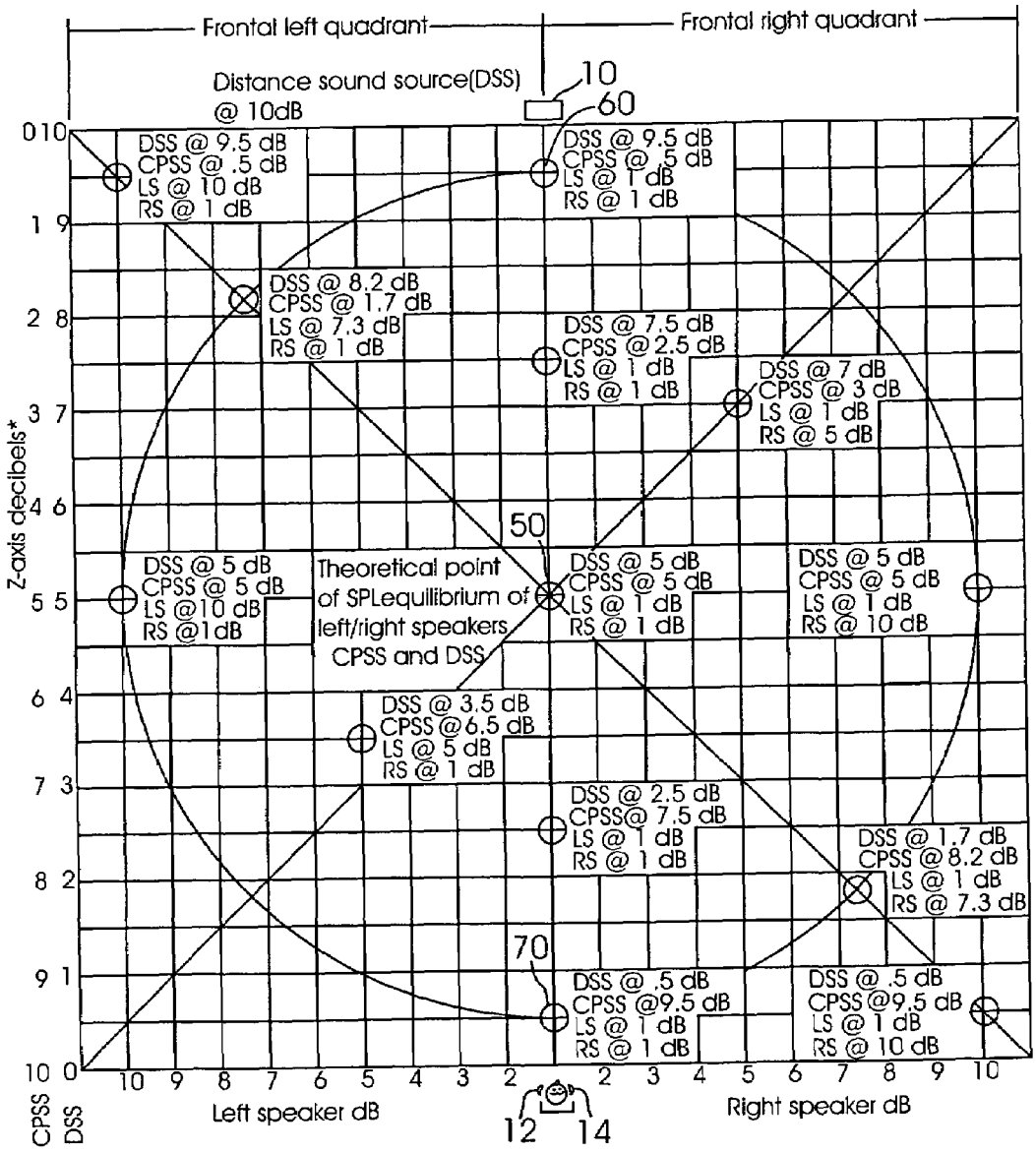
FIG. 7 is a geometric coordinate view of the formation and movement of sound images plotted in a sound space created in accordance with an embodiment of the present invention.

The ability of the CP/DSS bisonic format to maneuver sound fields and their sound images within a phantom sound space can be illustrated in geometric mathematical terms as illustrated in FIG. 7. By applying the principles of geometric coordinate points on a grid, the movements of sound images can be easily plotted. For this illustration, the z-axis is plotted against the x-axis of an x-y-z three-dimensional sound space. As noted earlier, the decibel intensity is represented on a one to ten scale, with ten representing the loudest sound intensity or pressure level. It is to be understood that the reference to decibels in FIG. 7 is only for the purposes of illustrating the intensity of the sound pressure level.

As described previously, the basic principle of this format's effectiveness to create a phantom three-dimensional sound space is based primarily on the Haas Principle of Precedence. This principle of precedence is also important to this format for maneuvering sound fields and their images in the sound space from location to location by varying the SPL of one speaker individually or in combination with other speakers. This SPL variation can be done manually or with electronically programmed means or by embedding the sonic intensity variations of the speakers in the sound tracks of recording medium during the recording or remixing process. FIG. 7 illustrates how a sound field and its images can be geometrically traversed laterally, longitudinally, circularly, or diagonally to any point in the sound space by varying the described relationship among the three speakers according to the Principle of Precedence.

The graph in FIG. 7 shows that when the decibels of left and right speakers of the close proximity sound source are at one decibel each, a stereo left/right balance is established and a sweet spot is formed for the lateral x-axis sound field. It also shows that a sound field and its images will move to the left or right from its previous location depending on which speaker has the greater sound intensity of the two. This is in accordance with the Precedence Effect. It is to be understood that the reference to decibels in FIG. 7 is only for the purposes of illustrating the intensity of the sound pressure level.

This principle also applies to the movement of a sound field and its images longitudinally along the z-axis of the sound space between the close proximity sound source and the distant sound source. In this case, the sound field and its images are traversed towards or away form the listener along the z-axis preferably by increasing or decreasing in unison the sound intensity of the two speakers of the close proximity sound source because the distant sound source is a community sound source and is shared by all the listeners and its SPL is preferably preset at an optimal level for the benefit of all the listeners. By integrating the maneuverability of the x-axis sound field and its images with the z-axis sound field and its images, the graph of FIG. 7 illustrates that recorded sound images can be effectively traversed to any point in a phantom three-dimensional sound space by varying the decibel relationship of the three speakers according to the principle of precedence. This ability to maneuver sound images in a phantom sound space illustrates the uniqueness of this close proximity/distant sound source, CP/DSS, bisonic format.

The bisonic nature of this CP/DSS format offers a listener choices of sound effect and clarity. The theoretical point of SPL equilibrium of left/right headset speakers 12 and 14 and the distant central speaker 10 is schematically illustrated by the reference point 50 in FIG. 7. A listener may listen to the reverberant sound field of the distant sound source alone by minimizing or muting the close proximity sound (so the distant sound source is dominant) which is schematically illustrated by the reference point 60. Alternatively, the listener may listen to the close proximity sound field by overriding with a dominating SPL of the close proximity sound source 10 over that of the distant source by applying the principle of precedence, which is schematically illustrated by the reference point 70. Or, as mentioned above, a listener may choose the amalgam of sounds formed by the SPL equilibrium of both sound sources. It is to be understood that the reference to decibels in FIG. 7 is only for the purposes of illustrating the intensity of the sound pressure level, where the decibel intensity along the x-axis and the z-axis in the coordinate plot is represented on a one to ten scale, with ten representing the loudest sound intensity or pressure level.

Experiments conducted with this CP/DSS concept indicate that the powers of electronic audio and digital processing through their own merits are not capable of developing the sought after phantom three-dimensional sound space from recorded sounds. The results also show that the three-dimensionality of recorded sounds are subject to the laws and principles of sound physics as much as natural sounds are, which means that to ignore or attempt to circumvent their demands result in a compromised pseudo form of sound space which depends greatly the listener's imagination to concoct. This is the dilemma that confronts both multi-speaker surround sound and virtualization formats.

The present invention can give a listener the ability to create one's own listening sound space in an audience of listeners and to be able to customize sound effects is beyond what other formats can offer. Giving each user of this format the opportunity to be personally involved with the "hands-on" participation in creating one's own individualized phantom three-dimensional sound space is an especially unique feature of this close proximity/distant sound source, CP/DSS, format.

While particular forms of the present invention have been illustrated and described, it should be understood that modifications to the disclosed embodiments of the invention can be made without departing from the spirit and scope of the invention, as defined by the appended claims.

The invention claimed is:

1. A method for providing a three-dimensional sound space to a listener, comprising the steps of:

providing a sound signal;

driving a left speaker with the sound signal, wherein the left speaker is located in close proximity to the left ear of the listener wherein the left ear is not isolated such that external sounds are allowed to impinge upon the pinna of the left ear;

driving a right speaker with the sound signal, wherein the right speaker is located in close proximity to the right ear of the listener wherein the right ear is not isolated such that external sounds are allowed to impinge upon the pinna of the right ear;

driving a central speaker with the sound signal, wherein the central speaker is located relatively distant from the listener such that the central speaker, the left speaker, and right speaker, form an isosceles triangle with the central speaker forming the apex of the isosceles triangle;

allowing the listener to individually adjust the sound pressure levels of the left and right speakers relative to the central speaker to achieve a phantom three-dimensional sound space created by the central, left and right speakers, wherein adjusting the sound pressure levels of the left and right speakers control the listener's perception of the virtual movement of phantom sound source image within the sound space created by the central, left and right speakers.

2. The method of claim 1, wherein the central speaker further includes a first central speaker and a second central speaker located at a height greater than the first central speaker to increase the height of sound image along the y-axis of the phantom three-dimensional sound space.

3. The method of claim 1, further comprising the steps of:

providing a video signal synchronized with the sound signal;

displaying a video image based on the video signal;

wherein the sound pressure levels of the left and right speakers relative to the central speaker are automatically adjusted to achieve a phantom three-dimensional sound space according to changes in the point of view represented in the displayed video image.

4. The method of claim 3, wherein the sound pressure levels of the left and right speakers are increased when the displayed video image is zoomed in from the listener's point-of-view.

5. The method of claim 3, wherein the sound pressure levels of the left and right speakers are decreased when the displayed video image is zoomed away from the listener's point-of-view.

6. The method of claim 1, wherein the sound pressure levels of the left and right speakers are adjusted in unison to control the listener's perception of the virtual movement of sound source image along the z-axis within the three-dimensional sound space created by the central, left and right speakers.

7. The method of claim 1, wherein the sound signal is a non-binaural sound signal.

8. A method for providing a three-dimensional sound space to a listener, comprising the steps of:

providing a signal comprising a video signal and a sound signal synchronized with the video signal;

displaying a video image based on the video signal;

driving a left speaker with the sound signal, wherein the left speaker is located in close proximity to the left ear of the listener wherein the left ear is not isolated such that external sounds are allowed to impinge upon the pinna of the left ear;

driving a right speaker with the sound signal, wherein the right speaker is located in close proximity to the right ear of the listener wherein the right ear is not isolated such that external sounds are allowed to impinge upon the pinna of the right ear; and driving a central speaker with the sound signal, wherein the central speaker is located relatively distant from the listener such that the central speaker, the left speaker, and right speaker, form an isosceles triangle with the central speaker forming the apex of the isosceles triangle;

automatically adjusting the sound pressure levels of the left and right speakers relative to the central speaker to achieve a phantom three-dimensional sound space; wherein the sound pressure levels of the left and right speakers are adjusted to control the listener's perception of the virtual movement of phantom sound image within the sound space created by the central, left and right speakers according to changes in the point of view represented in the displayed video image.

9. The method of claim 8, wherein the sound pressure levels of the left and right speakers are increased when the displayed video image is zoomed in from the listener's point-of-view.

10. The method of claim 8, wherein the sound pressure levels of the left and right speakers are decreased when the displayed video image is zoomed out from the listener's point-of-view.

11. The method of claim 8, wherein the sound pressure levels of the left and right speakers are adjusted in unison relative to the sound pressure level of the central speaker to control the listener's perception of the virtual movement of phantom sound image within the sound space along the z-axis within the three-dimensional sound space created by the central, left and right speakers.

12. The method of claim 8, wherein the central speaker further includes a first central speaker and a second central speaker located at a height greater than the first central speaker to increase the height of sound image along the y-axis of the phantom three-dimensional sound space.

13. The method of claim 8, wherein the sound signal is a non-binaural sound signal.

14. An apparatus for providing a three-dimensional sound space to a plurality of listeners, comprising:

a sound signal decoder for separating a sound signal into at least a first sound channel, a second sound channel, and a third sound channel;

a plurality of left speakers adapted to be driven by the first sound channel from the sound signal, wherein each left speaker is located in close proximity to the left ear of one listener wherein the left ear is not isolated such that external sounds are allowed to impinge upon the pinna of the left ear;

a plurality of right speakers adapted to be driven by the second sound channel from the sound signal, wherein the right speaker is located in close proximity to the right ear of the one listener wherein the right ear is not isolated such that external sounds are allowed to impinge upon the pinna of the right ear;

a central speaker adapted to be driven by the third sound channel from the sound signal, wherein the central speaker is located relatively distant from the listener such that the central speaker, the left speaker, and right speaker, form an isosceles triangle with the central speaker forming the apex of the isosceles triangle;

a sound pressure level controller for each individual listener to adjust the sound pressure levels of said listener's left and right speakers independent of the central speaker to achieve a phantom three-dimensional sound space created by the central, left and right speakers, wherein adjustment of the sound pressure level of the left and right speakers allows each listener to control said listener's perception of the virtual movement of phantom sound image within the sound space within the sound space created by the central, left and right speakers.

15. The apparatus of claim 14, wherein the central speaker further includes a first central speaker and a second central speaker located at a height greater than the first central speaker to increase the height of sound image along the y-axis of the phantom three-dimensional sound space.

16. The apparatus of claim 14, further comprising a video signal decoder receiving a video signal for displaying a video image, wherein the sound signal is synchronized with the video signal such that the sound pressure levels of the left and right speakers are increased when the displayed video image is zoomed in from the listener's perspective.

17. The apparatus of claim 14, further comprising a video signal decoder receiving a video signal for displaying a video image, wherein the sound signal is synchronized with the video signal such that the sound pressure level of the left and right speakers is decreased when the displayed video image is zoomed away from the listener's point-of-view.

18. The apparatus of claim 14, further comprising a headset device containing the left speaker and the right speaker, the headset holding the left speaker and the right speaker in place at equal angles to the pinna of each respective ear.

19. The apparatus of claim 14, wherein the sound signal decoder does not use a head response transfer function.

20. The apparatus of claim 14, wherein the sound signal decoder does not use cross-talk cancellation.

21. The apparatus of claim 14, wherein the sound signal is a non-binaural sound signal.

* * * * *